US008186075B2

(12) United States Patent
Beckett

(10) Patent No.: US 8,186,075 B2
(45) Date of Patent: May 29, 2012

(54) FORCED AIR FLOW ELECTRIC SHOE DRYER

(76) Inventor: Joel Beckett, Mercer Island, WA (US)

( * ) Notice: Subject to any disclaimer, the term of this patent is extended or adjusted under 35 U.S.C. 154(b) by 741 days.

(21) Appl. No.: 11/809,438

(22) Filed: May 31, 2007

(65) Prior Publication Data

US 2007/0277391 A1 Dec. 6, 2007

Related U.S. Application Data

(60) Provisional application No. 60/809,917, filed on May 31, 2006.

(51) Int. Cl.
*F26B 25/00* (2006.01)

(52) U.S. Cl. ..... 34/106; 34/107; 34/202; 392/384; 454/306; D32/58

(58) Field of Classification Search ..... 34/103, 34/104, 105, 202, 106, 210, 218, 90; 392/384, 392/385; D32/58; 454/306, 903
See application file for complete search history.

(56) References Cited

U.S. PATENT DOCUMENTS 1,344,930 A * 6/1920 Wolff ..... 12/142 G
1,444,264 A * 2/1923 O'Neill ..... 34/104
1,450,033 A * 3/1923 Gowan ..... 34/104
1,522,107 A * 1/1925 Deming ..... 34/104
1,651,463 A * 12/1927 Markatos ..... 126/230
1,667,315 A * 4/1928 Harris ..... 34/475
1,688,793 A * 10/1928 Schrenkeisen ..... 34/104
1,697,454 A * 1/1929 Brown et al. ..... 34/535
1,731,272 A * 10/1929 Schrenkeisen ..... 34/104
1,740,680 A * 12/1929 Burnham et al. ..... 34/83
1,740,681 A * 12/1929 Burnham et al. ..... 34/475
1,889,761 A * 12/1932 Schlesinger ..... 34/58
1,913,724 A * 6/1933 Schlesinger ..... 34/87
1,968,764 A * 7/1934 Harris ..... 34/557
1,969,953 A * 8/1934 Swartz ..... 34/79
2,018,406 A * 10/1935 Legge ..... 12/117.4
2,021,225 A * 11/1935 Condon ..... 12/59.7

(Continued)

FOREIGN PATENT DOCUMENTS

CH 679071 A * 12/1991

(Continued)

OTHER PUBLICATIONS

U.S. Appl. No. 11/809,438, filed May 31, 2007, Peet et al.

*Primary Examiner* — Stephen M. Gravini
(74) *Attorney, Agent, or Firm* — Dean A. Craine

(57) ABSTRACT

A small, portable electric shoe dryer that includes an elongated, narrow outer housing with three longitudinally aligned heating elements and a fan and motor assembly mounted on one end. Formed on the outer housing and around the fan and motor assembly is a fan vent opening. Formed on the opposite, distal end of the outer housing is a plurality of front and side body vent openings. In one embodiment, a three pole manual switch is mounted inside the outer housing that connects to the fan and motor assembly which draws dry air into the shoe from the top opening or forces moist air out of the shoe. In another embodiment, a pair of longitudinally aligned, upward extending wing elements are formed on the top surface which maintains air space when the inside of the shoe is adjacent to the top surface.

7 Claims, 7 Drawing Sheets

U.S. PATENT DOCUMENTS

| | | | | | |
|---|---|---|---|---|---|
| 2,076,735 | A | * | 4/1937 | Leindorf | 34/104 |
| 2,082,052 | A | * | 6/1937 | Frost et al. | 192/150 |
| 2,089,783 | A | * | 8/1937 | Chace et al. | 34/187 |
| 2,094,061 | A | * | 9/1937 | Cundall | 53/436 |
| 2,097,799 | A | * | 11/1937 | Perry et al. | 12/142 R |
| 2,254,870 | A | * | 9/1941 | Eaton | 12/41.5 |
| 2,275,430 | A | * | 3/1942 | Hart, Jr. et al. | 219/766 |
| 2,275,431 | A | * | 3/1942 | Winkley et al. | 219/775 |
| 2,295,475 | A | * | 9/1942 | Hurxthal | 34/213 |
| 2,304,983 | A | * | 12/1942 | Winkley et al. | 219/766 |
| 2,377,631 | A | * | 6/1945 | Joyce, Jr. | 12/142 R |
| 2,440,398 | A | * | 4/1948 | Fenwick | 34/105 |
| 2,444,195 | A | * | 6/1948 | Gruver | 34/104 |
| 2,446,234 | A | * | 8/1948 | Lieber | 34/104 |
| 2,465,362 | A | * | 3/1949 | Elliott | 34/104 |
| 2,481,930 | A | * | 9/1949 | Katchel | 12/129.4 |
| 2,671,277 | A | * | 3/1954 | Montgomery | 34/95.1 |
| 2,678,376 | A | * | 5/1954 | Lockwood | 392/385 |
| 2,710,905 | A | * | 6/1955 | Schramm | 219/523 |
| 2,712,051 | A | * | 6/1955 | Schramm | 219/523 |
| 2,862,705 | A | * | 12/1958 | Faeber | 226/92 |
| 2,953,805 | A | * | 9/1960 | Sevenich | 15/310 |
| 3,054,129 | A | * | 9/1962 | Dragoon | 15/311 |
| 3,131,036 | A | * | 4/1964 | Hirschberg | 34/95.1 |
| 3,154,392 | A | * | 10/1964 | Littman | 34/104 |
| 3,256,616 | A | * | 6/1966 | McGoldrick | 34/104 |
| 3,299,529 | A | * | 1/1967 | Roberts et al. | 34/104 |
| 3,417,482 | A | * | 12/1968 | Peet | 34/104 |
| 3,513,564 | A | * | 5/1970 | Gramprie | 34/104 |
| 3,645,009 | A | * | 2/1972 | Ketchum | 34/104 |
| D224,309 | S | * | 7/1972 | Wolff | D32/9 |
| 3,713,227 | A | * | 1/1973 | Cunningham et al. | 34/99 |
| 3,763,573 | A | * | 10/1973 | Bartram et al. | 34/99 |
| 3,775,861 | A | * | 12/1973 | Waters et al. | 34/99 |
| 3,791,045 | A | * | 2/1974 | Landis et al. | 34/99 |
| 3,793,744 | A | * | 2/1974 | Saita | 34/104 |
| 3,797,670 | A | * | 3/1974 | Lavemour | 211/94.03 |
| 3,798,788 | A | * | 3/1974 | Kuntz | 34/104 |
| 3,814,111 | A | * | 6/1974 | Doyle et al. | 132/272 |
| 3,832,789 | A | * | 9/1974 | Bartram | 34/99 |
| 3,974,840 | A | * | 8/1976 | Doyle et al. | 132/272 |
| 4,135,080 | A | * | 1/1979 | Wells, Jr. | 392/385 |
| 4,136,464 | A | * | 1/1979 | Hay | 34/104 |
| 4,171,580 | A | * | 10/1979 | Vabrinskas | 34/104 |
| 4,198,765 | A | * | 4/1980 | Miyamae | 34/104 |
| 4,200,993 | A | * | 5/1980 | Blanc et al. | 34/104 |
| 4,209,913 | A | * | 7/1980 | Wallin et al. | 34/442 |
| 4,369,586 | A | * | 1/1983 | Wedel | 34/125 |
| 4,596,078 | A | * | 6/1986 | McCartney | 34/103 |
| 4,654,982 | A | * | 4/1987 | Lee | 36/3 R |
| 4,689,897 | A | * | 9/1987 | Marsalona | 34/103 |
| 4,702,016 | A | * | 10/1987 | Grigsby et al. | 34/499 |
| 4,727,656 | A | * | 3/1988 | Jannach et al. | 34/104 |
| 4,768,293 | A | * | 9/1988 | Kaffka | 34/104 |
| 4,774,769 | A | * | 10/1988 | Dollst | 34/60 |
| 4,787,153 | A | * | 11/1988 | Chen | 34/87 |
| 4,908,957 | A | * | 3/1990 | Acosta et al. | 34/86 |
| 4,926,735 | A | * | 5/1990 | Smith | 84/453 |
| D310,742 | S | * | 9/1990 | Johnson | D32/58 |
| 4,967,060 | A | * | 10/1990 | Lomeli | 392/384 |
| 5,003,707 | A | * | 4/1991 | Chu | 34/104 |
| 5,016,364 | A | * | 5/1991 | Cochrane | 34/202 |
| 5,058,289 | A | * | 10/1991 | Guindon | 34/104 |
| 5,080,312 | A | * | 1/1992 | Ebey | 248/316.4 |
| 5,117,565 | A | * | 6/1992 | Willenbacher, Jr. | 34/103 |
| 5,125,169 | A | * | 6/1992 | Bader | 34/103 |
| 5,165,181 | A | * | 11/1992 | Acosta et al. | 34/90 |
| 5,179,790 | A | * | 1/1993 | Poulos | 34/104 |
| 5,185,939 | A | * | 2/1993 | Kimura | 34/105 |
| 5,199,188 | A | * | 4/1993 | Franz | 34/105 |
| 5,222,308 | A | * | 6/1993 | Barker et al. | 34/104 |
| 5,276,979 | A | * | 1/1994 | Gordon, Sr. | 34/600 |
| 5,287,636 | A | * | 2/1994 | Lafleur et al. | 34/104 |
| 5,291,669 | A | * | 3/1994 | Khoury et al. | 34/95.1 |
| 5,333,393 | A | * | 8/1994 | Hill et al. | 34/440 |
| D350,633 | S | * | 9/1994 | Wong | D32/59 |
| 5,365,675 | A | * | 11/1994 | Shabram, Jr. | 34/109 |
| 5,379,525 | A | * | 1/1995 | Raynor | 34/104 |
| 5,398,428 | A | * | 3/1995 | Wallace | 34/600 |
| 5,412,928 | A | * | 5/1995 | Reithel | 34/104 |
| 5,519,949 | A | * | 5/1996 | Gibson, Jr. | 34/600 |
| 5,528,840 | A | * | 6/1996 | Pajak et al. | 34/622 |
| 5,542,191 | A | * | 8/1996 | Shouse et al. | 34/104 |
| 5,604,993 | A | * | 2/1997 | Auckerman | 34/104 |
| 5,666,743 | A | * | 9/1997 | Dawson | 34/219 |
| 5,692,316 | A | * | 12/1997 | Antal | 34/106 |
| 5,720,108 | A | * | 2/1998 | Rice | 34/104 |
| 5,729,908 | A | * | 3/1998 | Braden | 34/104 |
| 5,778,556 | A | * | 7/1998 | Ohsugi | 34/106 |
| 5,819,433 | A | * | 10/1998 | Crooks | 34/104 |
| 5,836,087 | A | * | 11/1998 | Wilson et al. | 34/528 |
| 5,983,518 | A | * | 11/1999 | Ellenburg | 34/106 |
| 5,987,773 | A | * | 11/1999 | Lipscy | 34/106 |
| 6,067,729 | A | * | 5/2000 | Willis | 34/499 |
| 6,085,436 | A | * | 7/2000 | Peet | 34/104 |
| 6,216,359 | B1 | * | 4/2001 | Peet | 34/105 |
| 6,351,894 | B1 | * | 3/2002 | Lund et al. | 34/106 |
| 6,374,509 | B1 | * | 4/2002 | Jackson et al. | 34/106 |
| 6,378,224 | B1 | * | 4/2002 | Qualkinbush et al. | 34/80 |
| 6,499,227 | B1 | * | 12/2002 | Jacobson | 34/106 |
| 6,591,517 | B1 | * | 7/2003 | Moore | 34/106 |
| 6,606,801 | B2 | * | 8/2003 | Strang et al. | 34/437 |
| 6,705,023 | B1 | * | 3/2004 | Hoover | 34/90 |
| 6,732,447 | B2 | * | 5/2004 | Tomasi et al. | 34/90 |
| 6,745,496 | B2 | * | 6/2004 | Cassella | 34/621 |
| 6,766,594 | B2 | * | 7/2004 | DuRapau | 34/437 |
| D496,502 | S | * | 9/2004 | Cheng | D32/8 |
| 6,792,199 | B2 | * | 9/2004 | Levine et al. | 392/395 |
| 6,796,053 | B2 | * | 9/2004 | Lurie | 34/104 |
| 6,839,982 | B1 | * | 1/2005 | Hoover | 34/90 |
| 6,845,569 | B1 | * | 1/2005 | Kim | 34/106 |
| 6,861,396 | B2 | * | 3/2005 | Baker et al. | 510/109 |
| 6,918,193 | B2 | * | 7/2005 | Marolt | 34/104 |
| 6,962,004 | B2 | * | 11/2005 | DuRapau | 34/104 |
| D519,255 | S | * | 4/2006 | Peet et al. | D32/59 |
| 7,043,854 | B2 | * | 5/2006 | Peet et al. | 34/381 |
| D541,493 | S | * | 4/2007 | Peet | D32/8 |
| 7,238,106 | B2 | * | 7/2007 | Scott | 454/306 |
| 7,328,523 | B2 | * | 2/2008 | Vossoughi et al. | 34/90 |
| D565,260 | S | * | 3/2008 | Lam | D32/8 |
| D566,362 | S | * | 4/2008 | Peet | D32/58 |
| 7,367,136 | B1 | * | 5/2008 | D'Antonio | 34/107 |
| 7,389,596 | B2 | * | 6/2008 | Parks | 34/600 |
| D573,340 | S | * | 7/2008 | Shtyn et al. | D2/979 |
| 2002/0017117 | A1 | * | 2/2002 | Sunshine et al. | 68/3 R |
| 2002/0040534 | A1 | * | 4/2002 | Strang et al. | 34/104 |
| 2002/0077263 | A1 | * | 6/2002 | Baker et al. | 510/283 |
| 2002/0133969 | A1 | * | 9/2002 | Cassella | 34/201 |
| 2002/0148136 | A1 | * | 10/2002 | Wilson | 34/104 |
| 2003/0009902 | A1 | * | 1/2003 | Kirk | 34/104 |
| 2003/0084585 | A1 | * | 5/2003 | Tomasi et al. | 34/90 |
| 2003/0173478 | A1 | * | 9/2003 | Williams et al. | 248/176.1 |
| 2003/0213144 | A1 | * | 11/2003 | Jacobson | 34/427 |
| 2004/0010931 | A1 | * | 1/2004 | Naljotov | 34/104 |
| 2004/0064963 | A1 | * | 4/2004 | Marolt | 34/103 |
| 2004/0068888 | A1 | * | 4/2004 | Lurie | 34/90 |
| 2004/0071456 | A1 | * | 4/2004 | Levine et al. | 392/395 |
| 2004/0088879 | A1 | * | 5/2004 | DuRapau | 34/437 |
| 2004/0134237 | A1 | * | 7/2004 | Sunshine et al. | 68/3 R |
| 2004/0181963 | A1 | * | 9/2004 | Morris | 34/103 |
| 2005/0000107 | A1 | * | 1/2005 | DuRapau | 34/90 |
| 2005/0120579 | A1 | * | 6/2005 | Nicholson | 34/106 |
| 2005/0121534 | A1 | * | 6/2005 | Scott | 237/50 |
| 2005/0172509 | A1 | * | 8/2005 | Peet et al. | 34/104 |
| 2006/0005418 | A1 | * | 1/2006 | Kim | 34/108 |
| 2006/0032075 | A1 | * | 2/2006 | Vossoughi et al. | 34/95 |
| 2006/0254157 | A1 | * | 11/2006 | Arjomand | 52/27 |
| 2006/0272168 | A1 | * | 12/2006 | Parks | 34/104 |
| 2007/0101605 | A1 | * | 5/2007 | Susalla | 34/202 |
| 2007/0101609 | A1 | * | 5/2007 | Jerg et al. | 34/416 |
| 2007/0261263 | A1 | * | 11/2007 | Lee | 34/201 |
| 2007/0277391 | A1 | * | 12/2007 | Beckett | 34/443 |
| 2009/0193676 | A1 | * | 8/2009 | Shengguang et al. | 34/106 |

FOREIGN PATENT DOCUMENTS

| | | | | |
|---|---|---|---|---|
| CH | 679071 | A5 | * | 12/1991 |
| DE | 3510640 | A1 | * | 9/1986 |

| | | | | |
|---|---|---|---|---|
| DE | 10105228 | C1 | * | 7/2002 |
| JP | 54055860 | A | * | 5/1979 |
| JP | 01022237 | A | * | 1/1989 |
| JP | 01040027 | A | * | 2/1989 |
| JP | 01195805 | A | * | 8/1989 |
| JP | 01249030 | A | * | 10/1989 |
| JP | 02241427 | A | * | 9/1990 |
| JP | 03060619 | A | * | 3/1991 |
| JP | 04090739 | A | * | 3/1992 |
| JP | 04114621 | A | * | 4/1992 |
| JP | 04150824 | A | * | 5/1992 |
| JP | 04276229 | A | * | 10/1992 |
| JP | 04276230 | A | * | 10/1992 |
| JP | 05049587 | A | * | 3/1993 |
| JP | 06038918 | A | * | 2/1994 |
| JP | 06221468 | A | * | 8/1994 |
| JP | 08024204 | A | * | 1/1996 |
| JP | 2002136466 | A | * | 5/2002 |
| JP | 2002282197 | A | * | 10/2002 |
| JP | 2002360500 | A | * | 12/2002 |
| JP | 2005066070 | A | * | 3/2005 |
| JP | 2006102460 | A | * | 4/2006 |
| JP | 2007050061 | A | * | 3/2007 |

* cited by examiner

FORCED AIR FLOW ELECTRIC SHOE DRYER

This is a utility patent application which claims benefit of U.S. Provisional Application No. 60/809,917 filed on May 31, 2006.

BACKGROUND OF THE INVENTION

1. Field of the Invention

This invention pertains to shoe dryers and more particularly to small, portable shoe dryers designed to be placed inside a shoe.

2. Description of the Related Art

Small, portable shoe dryers designed to fit inside a shoe to remove moisture from the shoe are relatively common. Such shoe dryers include electric heating elements that connect to an external electricity source.

Shoe dryers should also be sufficiently long and narrow so that they can fit longitudinally inside the shoe and spaced apart from the inside surfaces from the shoe surface to maximize air circulation around the dryer.

A common user of a shoe dryer is someone who works or plays outdoors in wet conditions. Many of these users have only one pair of outdoor shoes or boots, so using a shoe dryer that quickly dries the shoes overnight would be highly desirable. Unfortunately, shoe dryers that use convection to dry the shoes are too slow.

What is needed is a small, portable shoe dryer that includes electric heating elements and a built-in fan that can either draw dry air inside the shoe, heat or circulate the air in the shoe and can force moist air out of the shoe.

SUMMARY OF THE INVENTION

It is an object of the present invention to provide a small, portable electric shoe dryer that allows optional air circulation.

It is another object of the present invention to provide such a shoe dryer that has a built-in electric fan.

It is another object of the present invention to provide such a shoe dryer with improved air flow around the shoe dryer.

These and other objects are met by a small, portable electric shoe dryer that includes an elongated, hollow outer housing with three longitudinally aligned heating elements and an electric fan mounted therein. Formed on the end of the outer housing and around the fan is a fan vent opening. Formed on the opposite end of the outer housing from the fan vent opening is a plurality of body vent holes. In a first embodiment, a three pole manual switch is mounted on the side of the outer housing that connects to the fan motor that allows the fan motor to selectively operate in opposite directions to draw air into the outer housing through the fan vent opening or through the body vent openings formed on the front section of the outer housing. In a second embodiment, the three pole manual switch is eliminated.

During use, the dryer may be longitudinally aligned inside the shoe so that the dryer's fan vent opening faces upward towards the top of the shoe and the body vent holes are located inside the shoe near the toe region. When the fan motor is activated, it draws air outside the shoe through the shoe's top opening and into the fan vent opening. Also, when the fan motor is activated the heating elements are activated too to heat the air before it is forced outward through the body vent openings. The heated air then circulates inside shoe and drys the inside surface. When a reversible switch is provided, the rotation of the fan motor may be reversed which causes moist air located inside the shoe to be drawn into the body vent holes. The air drawn into the body vent holes is then heated by the heating elements and forced elements and forced through the fan vent opening and out the top opening of the shoe.

In both embodiments, the outer housing includes a set of four legs that enable the outer housing to be horizontally aligned and elevated above the sole pad of the shoe so that air circulates around the outer housing. In the second embodiment, the outer housing also includes two longitudinally aligned wing elements formed on its top surface which press against the inside surface of the shoe and thereby create an air space above the outer housing for air to enter or exit the top holes formed on the outer housing.

The dryer is designed to be connected to a standard 120 volt A.C. electrical power source or to a 12 volt D.C. electrical power source. The dryer may also include a thermostat and auto turn-off switch which regulates heat and automatically turns off the heating elements when a predetermined temperature is obtained. Also, an optional light may be mounted on the outer housing or on the electrical plug that visually indicates that the dryer is electrical connected.

DESCRIPTION OF THE DRAWINGS

FIG. 9 is a top plan view of two shoe dryers that operate on 12 volts that are connected to an electrical plug capable of connecting to a 12 volt motor vehicle electrical plug-in.

DESCRIPTION OF THE PREFERRED EMBODIMENT(S)

Figure 1:
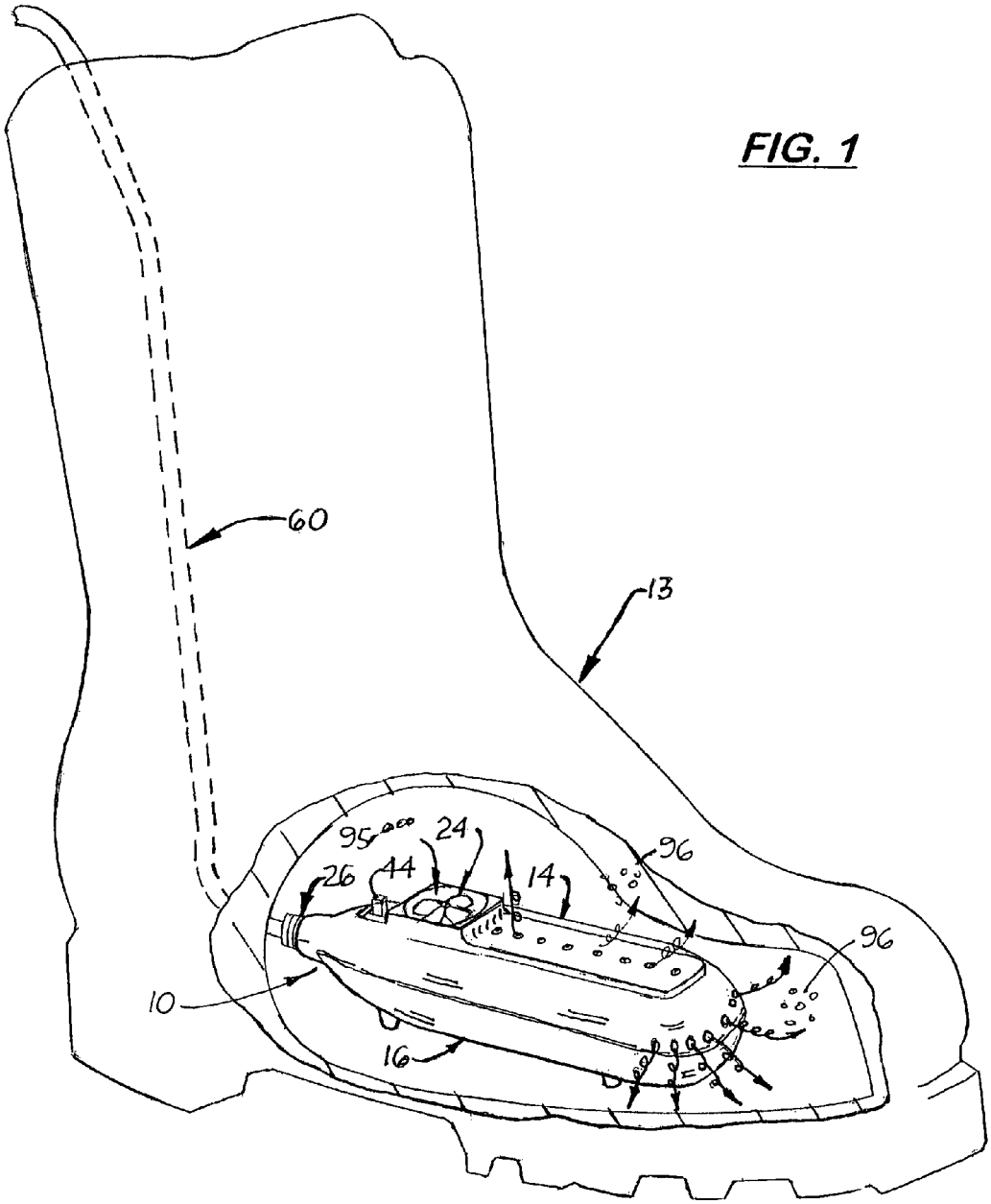
FIG. 1 is a perspective of a boot with a shoe dryer placed therein.
Figure 2:
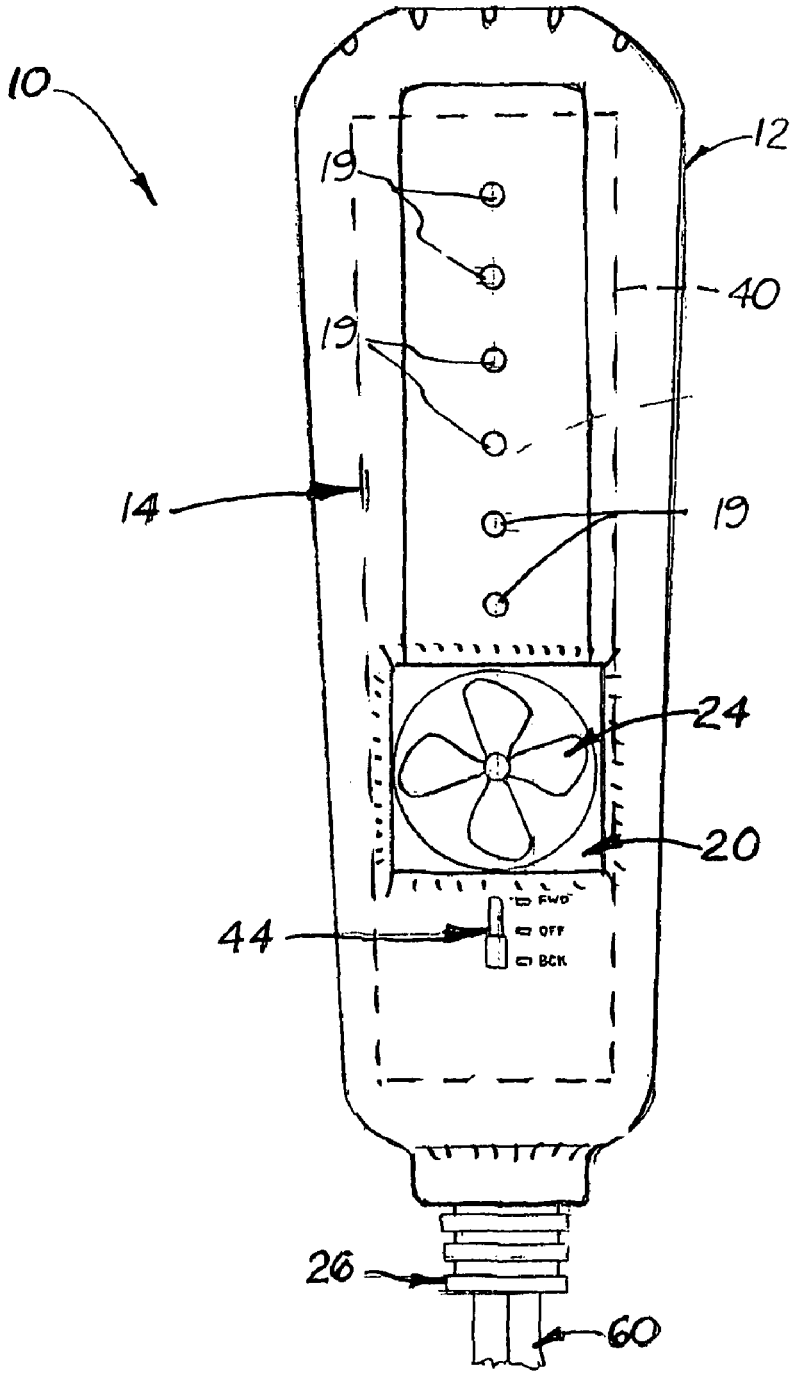
FIG. 2 is a top plan view of the shoe dryer.
Figure 3:
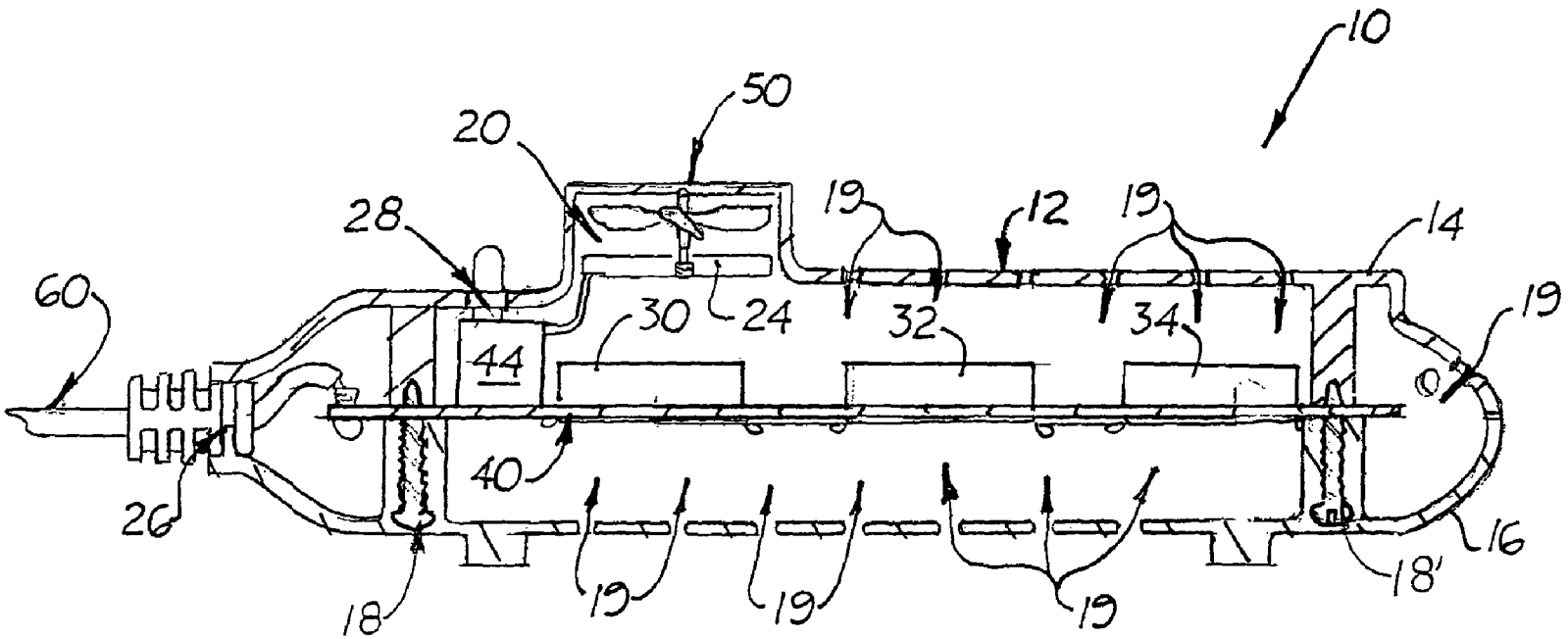
FIG. 3 is a sectional, side elevational view of the dryer.
Figure 4:
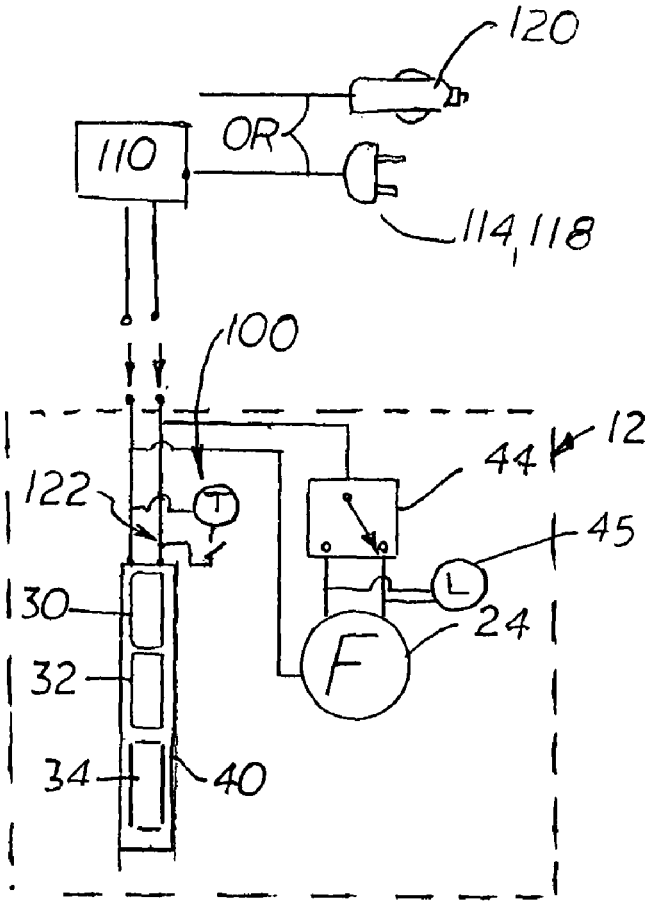
FIG. 4 is an electrical diagram of the first embodiment of the shoe dryer.

Shown in the accompanying FIGS. 1-9, there is shown a small, portable electric shoe dryer 10 that includes and elongated, hollow outer housing 12 with three electric heating elements 30, 32, 34 longitudinally aligned and mounted on a printed circuit board 40. The printed circuit board 40 is longitudinally aligned inside the outer housing 12.

In the first embodiment, the outer housing 12 is a narrow elongated structure with a top section 14 and a complimentary-shaped bottom section 16 connected together with two screws 18, 18'. Formed on the front surfaces of the top section 14 and on the bottom section 16 is a plurality of body vent holes 19 that enables air located near the front surfaces to flow into and out of the outer housing 12. Mounted on the top section 14 slightly rearward of the outer housing and its mid-line axis is a fan mounting cavity 20 designed to receive a small, combination electric fan and motor assembly, generally indicated by the reference number 24. Formed on the top section 14 and over the cavity 20 is a circular fan vent opening 50. Formed on the proximal end of the outer housing 12 is a wire opening 26 through which a 14-2 gauge electrical wire 60 may extend. Attached to the distal end of the wire 60 is, a standard U.S. or European two prong electrical plug 114, 118 designed to connect to a standard A.C. electrical plug-in or an automotive plug-in 120 designed to connect to an automotive D.C. Also formed on the outer housing 12 is a switch opening 28. In the first embodiment, a manual switch 44 is mounted inside the outer housing 12 and extends through the switch opening 28.

The manual switch 44 is connected to a printed circuit board 40. The switch 44 may include a LED bulb 45 which illuminates when the fan motor 25 or the heating elements 30, 32, 34 are activated.

In the preferred embodiment, the outer housing 12 is positioned inside the shoe 13 so that the fan vent opening 50 faces upward towards the top opening of the shoe 13 while the front surface of the outer housing 12 extends inward towards the toe box. When the switch 44 is selectively moved to a FORWARD-ON position, the fan motor 25 and heating elements 30, 32 and 34 are activated. Air 95 outside the shoe 13 is drawn through the shoe's top opening top opening and into the fan vent opening 50 and heated. The heated air 96 located inside the outer housing 12 is then forced outward through the body vent holes 19 and into the toe box which then circulates into the shoe 13 to dry out the surrounding surface. When the switch 44 is moved to a REVERSE-ON position, the fan motor 25 rotates in the opposite direction to draw moist air located inside the toe box area of the shoe 13 into the body vent holes 19. The moist air then circulates around the heating elements 30, 32, 34 and out through the fan vent opening 50. From the fan vent opening 50, the heated air is forced outward and exits the top opening in the shoe 13. In one embodiment, the heating elements 30, 32, 34 are activated when the switch 44 is moved to either the FORWARD-ON and REVERSE-ON positions. In another embodiment, the heating elements 30, 32, 34 are deactivated when the switch is moved to the REVERSE-ON position. When the switch 44 is moved to the OFF position, both the fan motor 25 and the heating elements 30, 32, 34 are deactivated. It should be understood, that when the dryer 10 is plugged into an electrical receptacle and the manual switch 44 is moved to the OFF position, the fan motor 25 is deactivated and the heating elements 30, 32, 34 may be activated. The LED bulb 45 are used primarily to indicate that the heating elements 30, 32, 34 are activated.

In the preferred embodiment, the outer housing 12 includes a set of four legs 17A-D that extend downward from the bottom section 16 that enable the outer housing 12 to be supported horizontally in an elevated above the sole pad of the shoe 13 so that air may circulate around the outer housing 12.

Figure 5:
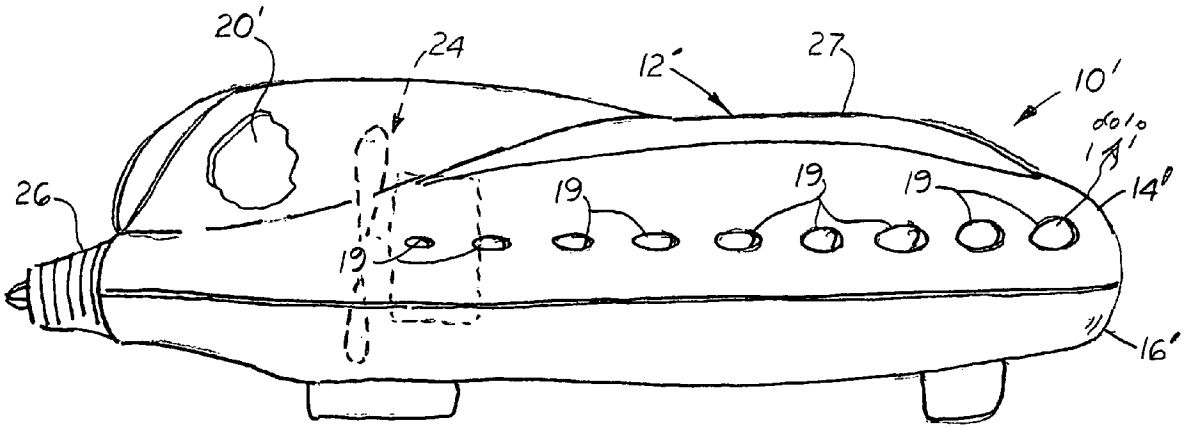
FIG. 5 is a side elevational view of a second embodiment of the shoe dryer with two wings elements mounted on the top surface.
Figure 6:
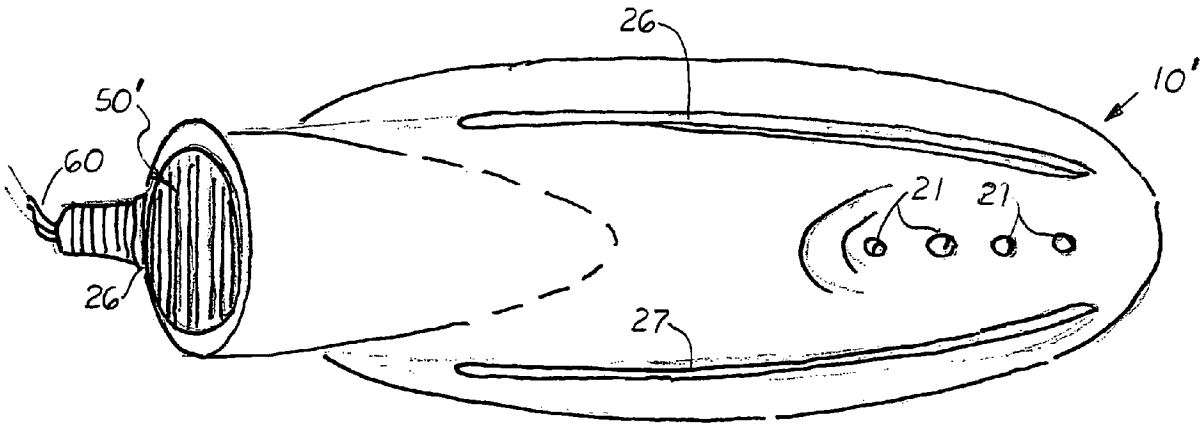
FIG. 6 is a top plan view of the second embodiment shown in FIG. 5.
Figure 7:
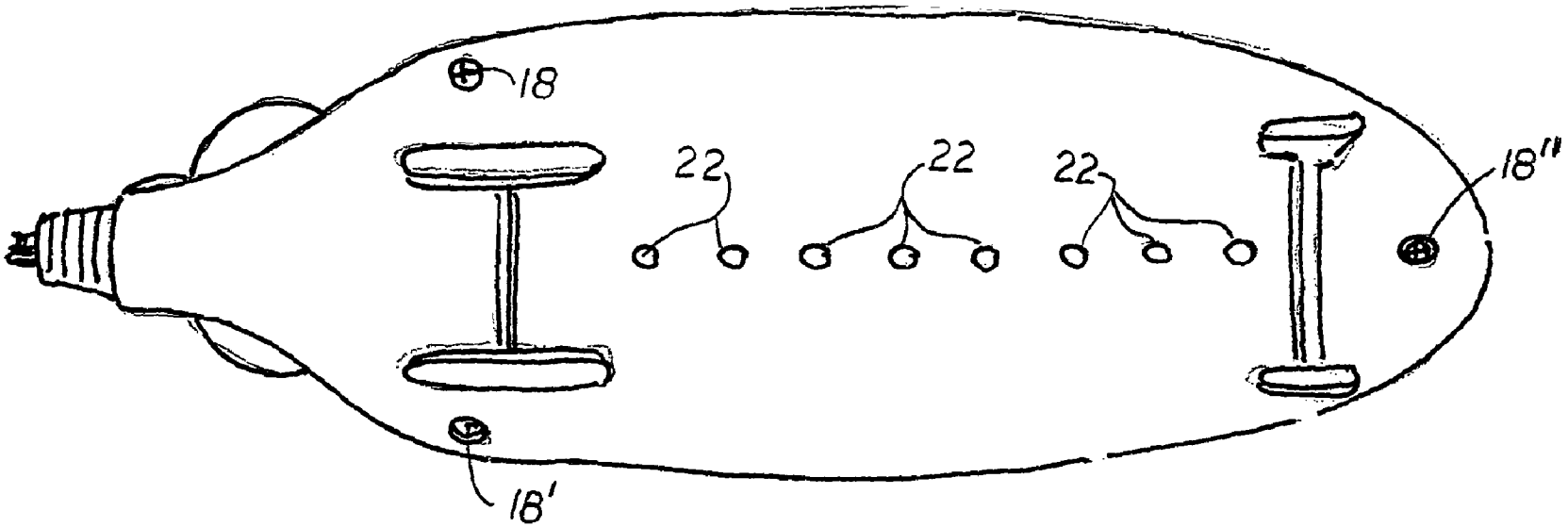
FIG. 7 is a bottom plan view of the second embodiment of the shoe dryer shown in FIGS. 5 and 6.

FIGS. 5-7 show a second embodiment of the shoe dryer 10' that includes a top section 14' and a bottom section 16' connected together with three screws 18, 18', 18". Extending along the opposite sides and along the front surface of the top section 14' is a plurality of body vent holes 19 that enables air located near the front surfaces to flow into and out of the outer housing 12'. Formed centrally along the housing's longitudinal axis is a plurality of top vent holes 21. Mounted on the bottom surface 16' is a plurality of longitudinally aligned bottom vent holes 22 (See FIG. 6). Extending diagonally upward and rearward on the top section 14' is a fan mounting cavity 20' designed to receive the electric fan and motor assembly 24. Formed on the top section 14' and over the cavity 20' is an oval shaped fan vent opening 50'. Formed on the proximal end of the outer housing 12 is a wire opening 26 through which an electrical wire 60 may extend. The outer housing 12' also includes two longitudinally aligned wing elements 26, 27 formed on opposite sides of the top section 14'. During use, the two wing elements 26, 27 press against the inside surface of the shoe and thereby create an air space above the outer housing 12' for air to enter or exit the top holes 21.

Figure 8:
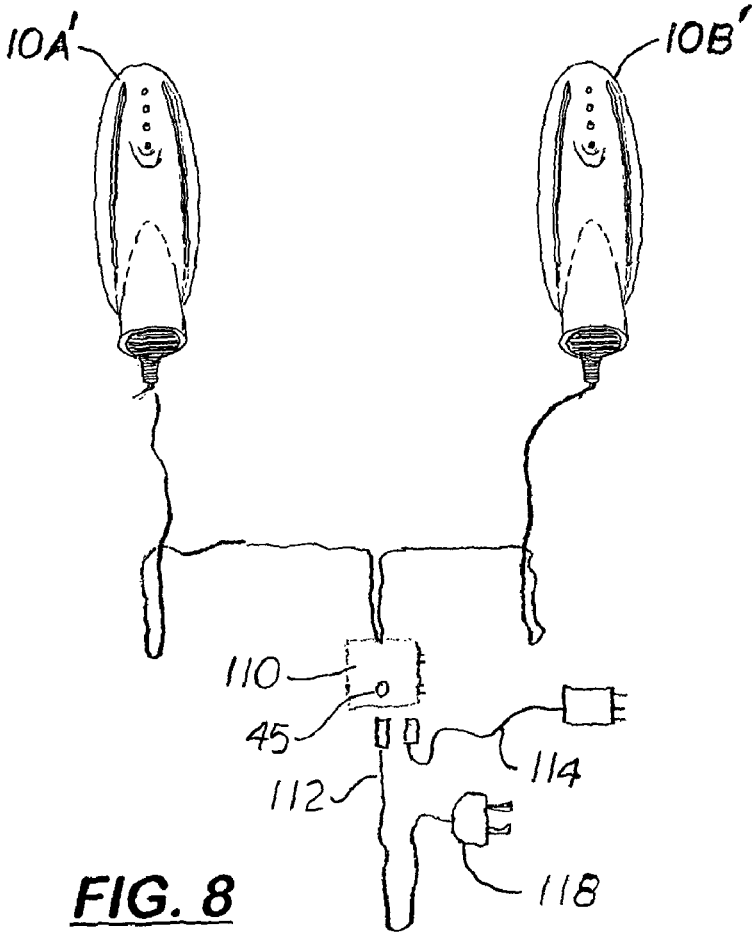
FIG. 8 is a top plan view of two shoe dryers that operate on 12 volts that are connected to universal transformer thereby enabling the two shoe dryers to be connected to a U.S. or European electrical wall socket.
Figure 9:
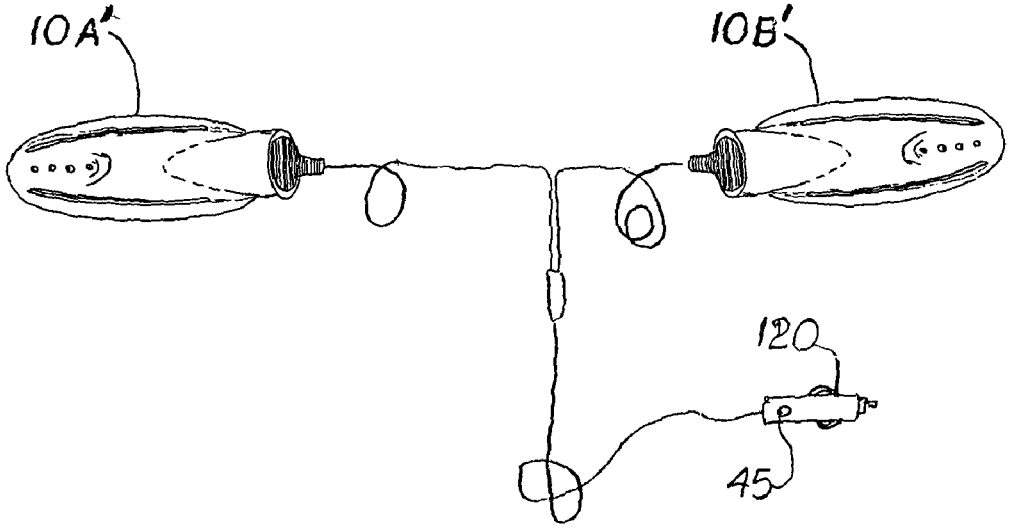

In FIG. 8, two shoe dryers 10A' 10B' are shown that operate on 12 D.C. volts that are connected to a universal transformer 110 thereby enabling the two shoe dryers 10A', 10B', to be connected to a single U.S. or European style electrical cord 112, 114. FIG. 9 is a top plan view of the two shoe dryers 10A', 10B' that operate on 12 D.C. volts that are connected to an electrical plug 120 capable of connecting to a 12 volt motor vehicle electrical plug-in. plug-in. Mounted on the adapter 110 or on the plug 120 is an LED 45 used as an activation indicator.

It should be understood that the dryer 10, 10' may include an integrated thermostat 100 and an auto turn-off switch 122 which regulates the heat inside the shoe and automatically turns off the heating elements 30, 32, 34 when a predetermined temperature (approximately 99 degrees F.) is obtained.

In compliance with the statute, the invention described herein has been described in language more or less specific as to structural features. It should be understood however, that the invention is not limited to the specific features shown, since the means and construction shown, is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A forced air flow electric shoe dryer positioned inside a shoe, said shoe dryer comprising:

a. a hollow, elongated outer housing positioned inside said shoe, said outer housing includes a top section, bottom section and a fan cavity, said outer housing including a distal end and a proximal end, formed on said top section is a plurality of body vent holes, formed over said fan cavity is a vent opening, said outer housing also includes a wire opening and a switch opening;

b. a plurality of feet attached to said bottom section of said outer housing to elevate said outer housing to allow air to circulate around said outer housing when said outer housing is placed in a horizontal position in said shoe;

c. a combination fan and motor assembly located inside said fan cavity;

d. a printed circuit board longitudinally aligned inside said outer housing, said printed circuit board including at least one longitudinally aligned electric heating element;

e. a three position switch connected to said fan and motor assembly and said three heating elements, said three position switch includes an Off position, a Forward-On position, a Reverse-On position; and, f. an electric wire extended through said wire opening to connect said fan and motor assembly and said three heating elements to an external electrical source.

2. The shoe dryer, as recited in claim 1, further including a thermostat and auto-turn off switch used to activate and deactivate the heating element when a pre-determined temperature is obtained.

3. The shoe dryer, as recited in claim 1, further including a light mounted on said outer housing used to indicate when said fan and motor assembly or said heating element are activated.

4. The shoe dryer, as recited in claim 2, further including a light used to indicate when said fan and motor assembly or said heating element are activated.

5. A portable, forced air flow, internally disposed shoe dryer, comprising:

a. a hollow, elongated outer housing positioned inside a shoe, said outer housing includes a top section, bottom section and a fan cavity, said outer housing including a distal end and a proximal end, formed on said top section is a plurality of side body vent holes, top holes, and bottom holes formed over said fan cavity is a vent opening;

b. a plurality of feet attached to said bottom section outer housing to elevate said outer housing in a horizontal position inside a shoe;

c. a combination fan and motor assembly located inside said fan cavity;

d. a printed circuit board longitudinally aligned inside said outer housing, said printed circuit board including at least one longitudinally aligned electric heating element;

e. at least one fixed longitudinally aligned, upward extending wing element formed on said top surface of said outer housing that creates an-air space between the top section of said outer housing and the inside surface of the shoe when said outer housing is positioned inside said shoe;

f. a three-way switch connected to said printed circuit board used to selectively control the activation of said fan motor assembly and said electric heating element and the forward or reverse directional flow of air into and out of said outer housing; and, g. an electric wire extended through said wire opening to connect said fan and motor assembly and said three heating elements to an external electrical source.

6. The shoe dryer, as recited in claim 5, further including a light used to indicate when said fan and motor assembly or said heating element are activated.

7. An inward or outward air flow shoe drier that fits inside a shoe, comprising;

a. a straight, elongated outer housing with an internal cavity and an air inlet port, said outer housing fits into said shoe;

b. a plurality of feet attached to said outer housing to elevate said outer housing in a horizontal position inside said shoe;

c. a combination fan and motor assembly located in said internal cavity in said outer housing:, d. a longitudinally aligned electric heating element located in said internal cavity;

e. a three position switch connected to said combination fan and motor assembly and said heating element, said three position switch includes an Off position, a Forward-On position, a Reverse-On position, and, f. means for supplying an electric current to said motor, said electric heating element and said three position switch.

* * * * *